US005088600A

United States Patent [19]

Kopp, Jr.

[11] Patent Number: 5,088,600

[45] Date of Patent: Feb. 18, 1992

[54] GOLF CLUB SHAFT PROTECTOR TUBE

[76] Inventor: Fred H. Kopp, Jr., 7 Roxbury Rd., Westbury, N.Y. 11590

[21] Appl. No.: 664,662

[22] Filed: Mar. 5, 1991

[51] Int. Cl.[5] ..... B65D 85/20

[52] U.S. Cl. ..... 206/315.2; 150/160; 206/315.6

[58] Field of Search ..... 273/162 R, 32 R, 32 B, 273/32 E; 150/160; 206/315.2, 315.6, 315.3

[56] References Cited

U.S. PATENT DOCUMENTS

| | | | |
|---|---|---|---|
| 1,886,464 | 11/1932 | Bright | 150/160 |
| 2,752,973 | 7/1956 | Stamp | 206/315.6 |
| 3,053,298 | 9/1962 | Stamp | 206/315.6 X |
| 3,603,368 | 11/1969 | Brenner | 150/160 |
| 3,664,399 | 5/1972 | Neff | 150/160 |
| 3,965,955 | 6/1976 | Price | 150/160 |
| 4,195,677 | 4/1980 | Hagg et al. | 150/160 |
| 4,378,832 | 4/1983 | Thompson | 150/160 |
| 4,497,404 | 2/1985 | Lowrance | 150/160 |
| 4,662,415 | 5/1987 | Proutt | 273/162 R |

*Primary Examiner*—George J. Marlo
*Attorney, Agent, or Firm*—Malloy, Downey & Malloy

[57] ABSTRACT

This protective device is particularly designed to protect golf club shafts, especially graphite and other exotic material golf club shafts. Primarily, it consists of an elongated, hollow tube lined interiarly with a soft material which extend over the outer ends thereof, which encases the shaft and handle grip of a golf club. The device being receivable within a conventional golf club bag.

3 Claims, 1 Drawing Sheet

GOLF CLUB SHAFT PROTECTOR TUBE

FIELD OF INVENTION

Figure 1:
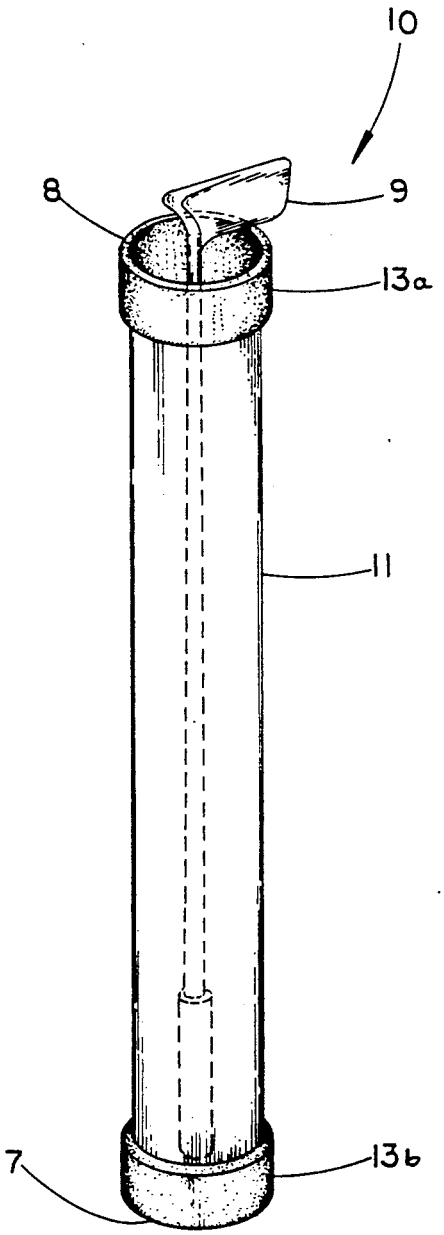

This invention relates to golf devices and more particularly to a hollow, elongated tube lined with a soft material for protecting golf club shafts, in particular, golf club shafts made of graphite and/or other exotic material.

DISCUSSION OF PRIOR ART

Graphite and other exotic material golf club shafts are relatively new on the market. These types of shafts are extremely suseptible to scratching and marring during normal withdrawal and return of club to storage in golf bag. Heretofore the only forms of protection for exotic golf club shafts presently available on the market are (1) soft material linings inside the upper part of golf bags and (2) knitted head covers with an extended neck.

The lining of the upper part of a golf bag only protects that part of the shaft which comes into contact with the lining, thus exposing the remaining part of the shaft to marring and scratching by contact with other club shafts and the inner wall of the golf club storage bag.

With knitted head covers, golfers tend to have a problem with their removal and finding temporary storage, which often detracts from the enjoyment of the game. Over the years golfers have used head covers for clubs commonly known as woods; the use of covers on the clubs commonly called irons would mean a need for more head covers, thus more frequent problems with removal and storage of head covers.

Thus a structure which integrally stores the golf club shaft and which does not require temporary separation and maintenance is desired both for the convenience of the player and to reduce paraphernalia involved in the protection and storage of the golf clubs.

The present invention overcomes these problems by providing a protective device which shields the golf club shafts from any hard surfaces and from contact with other club shafts. The protective device being a hollow, elongated tube; each of which is for receiving a different golf club. Said hollow, elongated tube being lined with a soft material in order to protect the finish of a graphite or other exotic material golf club shaft. The protective device being receivable within a golf club bag.

OBJECTS AND ADVANTAGES

Accordingly, it is the general purpose and object of the present invention to provide a golf club shaft protecting device conformed as the conventional club separator tube which furthermore includes a lining of a soft material, in order to protect the finish of a graphite or other exotic material golf club shaft. It is an object of the invention to protect the individual golf club shafts enclosed thereby against chipping, marring, or other damage, thereby significantly adding to the useful life of the golf clubs as well as maintaining a new-like appearance.

Another object of this invention is to provide a protective device for a golf club shaft, which will not become an irritating part of playing golf. A device that will enable the golfer to play without any annoyances caused by cumbersome protective devices for graphite and other exotic golf club shafts, these types of clubs being relatively expensive.

It is still a further object of this invention to provide a cushioning means in each of the tubes to protect the golf club shafts and minimize movement and rattling of the shafts and causing damage during transport as on a cart for example.

And yet, still another object of this invention is to provide a golf club shaft holder which may be readily sized to accommodate different grip sizes for individual golfers.

Still another object of this invention is to provide a protective device for a golf club shaft, which is simple in design, inexpensive to manufacture, rugged in construction, easy to use and efficient in operation.

It is apparent that many modifications of this invention as herein before set forth may be made without departing from the spirit and scope therefore. The specific embodiments described are given by way of example only and the invention is limited only by the terms of the appended claims.

A preferred embodiment of the invention is shown in the accompanying drawing wherein FIG. 1 is a perspective view of a golf club shaft protector tube made in accordance with the principles of the present invention.

Figure 2:
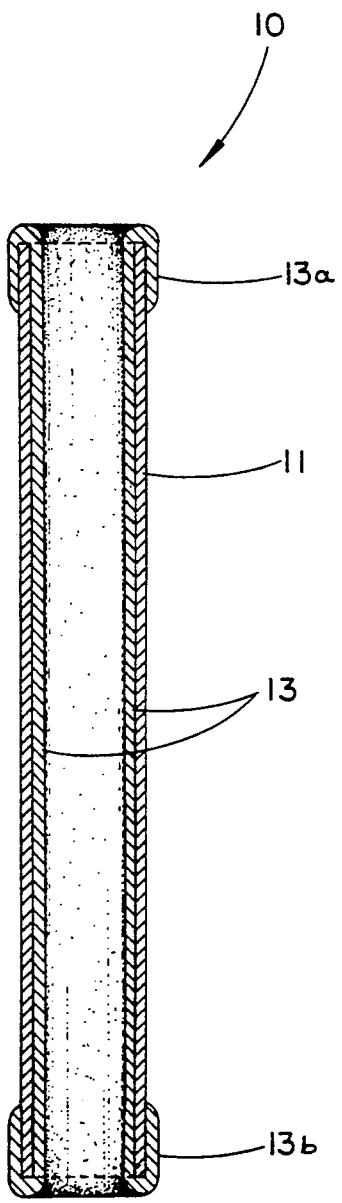

FIG. 2 is a cross sectional view of FIG. 1.

REFERENCE NUMERALS IN DRAWING

7 lower tube opening
8 upper tube opening
9 golf club
10 golf club shaft protective tube
11 elongated hollow tube
13 inner soft material lining
13A upper soft material outer lining
13B lower soft material outer lining

DESCRIPTION OF INVENTION

In accordance with the present invention there is provided a protective device 10 for a golf club shaft comprising: a first elongated tube 11 within which said golf club 9 can be stored. Said tube 11 being made of plastic or other suitable material similiar to those presently used for holding golf clubs in conventional golf club bags. The interior dimensions of the tubes 11, of course, are such that a conventional golf club handle may be inserted thereinto. The length of such tube 11 being able to fit into a conventional golf club bag. Said tube 11 being lined 13 internally with a soft synthetic material or other suitable material to allow protection of golf club shaft. Said outer lining 13A also overlapping the upper tube opening 8 and said lower lining 13B overlapping the lower tube opening 7 of tube 11 to provide a secure anchoring of lining 13. According to the invention the lining 13,13A,13B can be joined to the tube 11 by adhesives, heat sealing or any other suitable method known in the art.

In use, the shaft and handle grip of golf club 9 are inserted into the upper opening 8 of said elongated tube 11 which is lined 13 with a soft material.

It is to be understood that the specific embodiment discussed above is only illustrative of the principles of the present invention, and that numerous other embodiments and configurations could be made by those skilled in the art without departure from the spirit and scope of the invention.

What I now claim is:

1. A golf club shaft protecting device for use within a golf club bag; said device comprising:

a hollow, elongate, cylindrical tube, said tube including open opposite distal ends structured and disposed to receive a handled end of a golf club therethrough such that a head portion of the golf club extends from one of the ends thereof, said tube being substantially rigid and elongate so as to protectively cover and encase the shaft and the handle of the golf club, thereby protecting it from shocks and impacts within the golf club bag, said tube further including a substantially soft material lining attached in covering, non-sliding relation to an interior surface thereof, said lining including protruding end portions which extend beyond said open opposite distal ends of said tube, and said protruding end portions of said lining being structured and disposed to be overlapped and secured in protective, covering relation over said opposite distal ends of said tube on an outer portion of said tubes, thereby allowing a plurality of said tubes to fit securely in substantially snug fitting, adjacent relation within the golf bag while preventing said lining from sliding into said tube.

2. A golf club shaft protecting device as recited in claim 1 wherein said lining is made of felt or a like soft and shock absorbent material.

3. A golf club shaft protecting device as recited in claim 2 wherein said tube may vary in length and diameter so as to more adaptively cover the shaft and handle of a variety of golf club sizes.

* * * * *